United States Patent [19]

Chern

[11] Patent Number: 4,945,278

[45] Date of Patent: Jul. 31, 1990

[54] FLUORESCENT TUBE POWER SUPPLY

[75] Inventor: Tian P. Chern, Tainan, Taiwan

[73] Assignee: Loong-Tun Chang, Taiwan

[21] Appl. No.: 242,475

[22] Filed: Sep. 9, 1988

[51] Int. Cl.[5] ..... H05B 41/24; H05B 41/29

[52] U.S. Cl. ..... 315/209 R; 315/244; 315/DIG. 2; 315/DIG. 5

[58] Field of Search ..... 315/200 R, 205, 209 R, 315/209 T, 226, 227, 244, DIG. 2, DIG. 5, DIG. 7

[56] References Cited

U.S. PATENT DOCUMENTS 4,775,822 10/1988 Statnic et al. ..... 315/244 X 4,782,268 11/1988 Fahnrich et al. ..... 315/244 X

*Primary Examiner*—David Mis

*Attorney, Agent, or Firm*—Christie, Parker & Hale

[57] ABSTRACT

The inventive power supply converts the low-frequency alternating current source into high-voltage direct current. An induction windings network series connected to the fluorescent tube provides a feedback signal to a pair of bridging transistors which then respectively alternates to be on or off to output a high-frequency, high-voltage signal for the tube to use. The network is connected so that the inductors provide the feedback signal, the signal having a resonant frequency suitable for activating the tube. The light emitted in accordance with this invention is continuous, due to the inventive feedback, in comparison to the light emitted by a fluorescent tube utilizing a transformer and a starter.

3 Claims, 1 Drawing Sheet

FLUORESCENT TUBE POWER SUPPLY

BACKGROUND OF THE INVENTION

The commonly used power supply for a fluorescent tube generally includes a transformer and a starter, wherein the starter is suddenly enabled and further activates the transformer producing a sudden high-voltage to trigger the fluorescent tube. This kind of fluorescent tube power supply operates at a frequency of 60 HZ or so, such that the flashing frequency of the tube is also 60 HZ, which causes a flicker common to fluorescent tube and is harmful for the eyes. Besides, the additionally incorporated transformer and starter make the fluorescent tube bulky and weight which become the defects thereof.

The present invention relates to a fluorescent tube power supply which utilizes a rectifier doubler circuit to convert the input of low-frequency alternating current into high-voltage direct current, which is then utilized to activate a pair of bridging transistors. The current flowing through an induction windings network which is connected to the fluorescent tube will induce an electromotive force to feedback to the transistors, thus producing a resonant high-frequency for use by the fluorescent tube. The high-frequency and high-voltage electric signals not only do away with the conventional transformer and starter but also eliminate the flashing of the tube.

SUMMARY OF THE INVENTION

It is a primary object of the present invention to provide a fluorescent tube power supply which will produce a high-frequency and high-voltage electric signal for the fluorescent tube to use; and due to the high-frequency, eliminate the flicker common to fluorescent tube which causes harm to the eyes.

A further object of the present invention is to provide a fluorescent tube power supply which obviates the necessity of a transformer and a starter.

DETAILED DESCRIPTION OF THE PREFERRED EMBODIMENT

Figure 2:
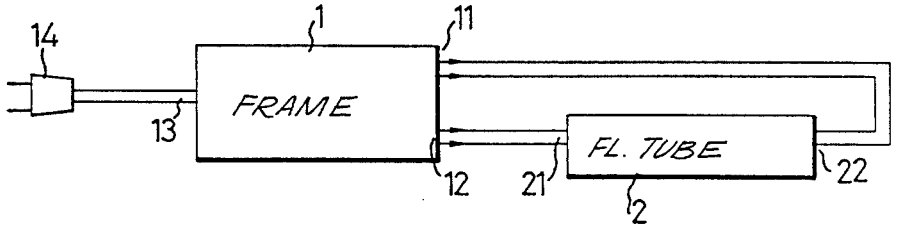
FIG. 2 shows a block diagram of the present invention.

Referring first to FIG. 2, the present invention constitutes a single frame 1 having one input line 13 and two output lines 11, 12. the input line 13 connects to a conventional alternating current power source via a plug 14 thereon to provide the required electrical energy to the frame 1.

Through the rectification and the high-frequency oscillation functions inside the frame 1, the high-voltage and high-frequency electrical signals can be generated in the two output lines 11, 12 and can be connected respectively to a first and a second filament 22, 21 of a fluorescent tube 2 (Fl. tube) to complete the electric circuit.

Figure 1:
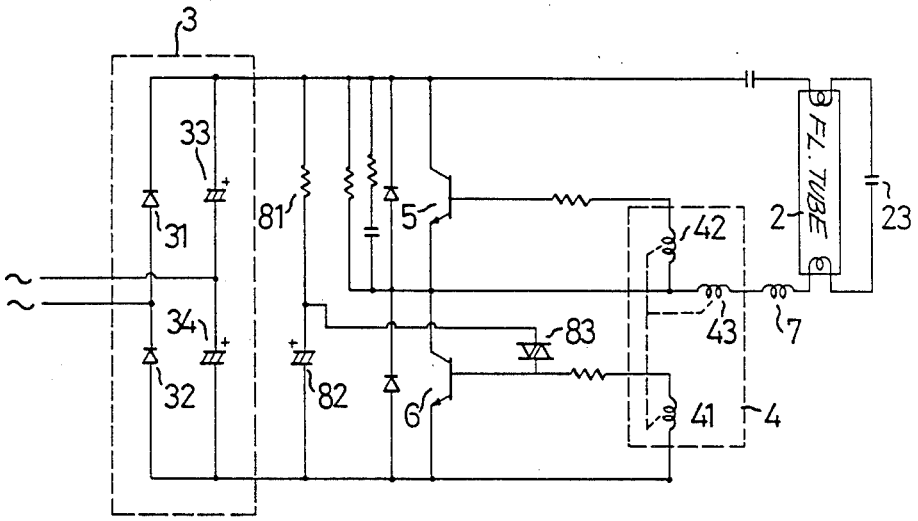
FIG. 1 shows a circuit diagram of the present invention.

Referring to FIG. 1, the circuit constitutes primarily a rectifier doubler circuit 3, a first and a second transistor 5, 6 and induction windings 4. The rectifier doubler circuit 3 includes a first and a second rectifier 31, 32 as well as a first and a second filtering electrolytic capacitor 33, 34 to form a fullwave filtering rectifier doubler circuit capable of converting the input of alternating current into direct current and also doubling the voltage to become higher for later use by the transistors 5, 6. After doubling, the positive line is directly connected to the fluorescent tube 2 and the load current line then passes through the induction windings 4. The induction windings include a first inductor 41, a second inductor 42 and a third inductor 43. The first and the second inductors 41, 42 connect respectively to the bases of the first and second transistors 5, 6 to provide triggering signals. The first and the second transistors 5, 6 bridge the positive line and the negative line and the connecting point between the first and the second transistors 5, 6 becomes the output terminal which series connects to the fluorescent tube 7 through the third inductor 43 of the induction windings 4. The triggering loop of the present invention utilizing a resistor 81 and an electrolytic capacitor 82 to act as a delay circuit is series connected through a DIAC 83 to further connect to the base of the second transistor 6. Also, a resonance capacitor 23 is connected across the filaments 21, 22 of the fluorescent tube 2 one end of which connects to the third inductor 43 to form a LC resonance network such that the present invention can be activated at its resonant frequency. Further, a filtering inductor 7 is series connected to the fluorescent tube 2 to filter out extraneous signals.

When the plug 14 is connected with the alternating current power source, the DIAC 83 will activate the second transistor 6 to effect an imbalance condition. At the same time, the first, second and third inductors are inductively coupled so that the current flowing through the third inductor 43 to induces respectively an opposite electromotive force in the first inductor 41 and the second inductor 42 such that the originally activated second transistor 6 is disabled, and instead the first transistor 5 is now activated. Since the first transistor 5 is activated, the direction of the current flow in the third inductor 43 is altered and the phase of the electromotive force in the first and the second inductors 41, 42 is complemented. Thus, the resonance frequency function is effected and the high-frequency electric power is produced.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A fluorescent tube power supply comprising:

a rectifier doubler circuit including a first and a second rectifier as well as a first and a second filtering electrolytic capacitor to form a full-wave filtering rectifier doubler circuit capable of converting an input of alternating current into direct current and also doubling the voltage to become higher for later use;

an induction windings network comprising a first inductor, a second inductor and a third inductor; the first and second inductors connect to respective bases of a first and a second transistor to provide triggering signals; the first and the second transistors having conductive paths linked at a connecting point and bridging a positive line and a negative line, and the connecting point between the first and the second transistors functions as a terminal, which series connects to a fluorescent tube through the third inductor of the induction windings network;

a resistor and an electrolytic capacitor to act as a delay circuit in series connected to a DiAC to further connect to the base of the second transistor; a resonance capacitor is connected across the filaments of the fluorescent tube and connects to the third inductor to form an LC resonance network having a resonant frequency such that the power supply activates the fluorescent tube at the resonant frequency; and a filtering inductor series connects to the fluorescent tube to filter out extraneous signals, wherein the first, second and third inductors are inductively coupled for inducing an electromotive force in the first and second inductors opposite to a current in the third inductor to alternately disable the second transistor and provide a triggering signal to the first transistor, and disable the first transistor and provide a triggering signal to the second transistor.

2. A power supply for a fluorescent tube comprising:

(a) doubler rectifier means for receiving an alternating current and converting it into a direct current with double a voltage of the alternating current;

(b) a positive line and a negative line for receiving the direct current;

(c) a first transistor and a second transistor having respective conductive paths connected in series and linked at a connecting point for bridging the positive and negative lines;

(d) a network of inductors including a first inductor and a second inductor connected to respective bases of the first and second transistors for providing respective triggering signals to the first and second transistors, wherein the network of inductors further includes a third inductor and the connecting point of the first and second transistors functions as a terminal which series connects to the fluorescent tube through the third inductor;

(e) a DIAC and a delay circuit serially connected, the DIAC being further connected to the base of the second transistor;

(f) a resonance capacitor connected across first and second filaments of the fluorescent tubes and connected to the third inductor for forming an LC resonance network having a resonant frequency for activating the fluorescent tube; and (g) filter means serially connected between the third inductor and the fluorescent tube for filtering out extraneous signals, wherein the first, second and third inductors are connected for inducing an electromotive force in the first and second inductors opposite to a current in the third conductor to alternately disable the second transistor and provide a triggering signal to the first transistor, and disable the first transistor and provide a triggering signal to the second transistor.

3. The power supply of claim 2, wherein the filter means comprises an inductor.

* * * * *

UNITED STATES PATENT AND TRADEMARK OFFICE
CERTIFICATE OF CORRECTION

PATENT NO. : 4,945,278

DATED : July 31, 1990

INVENTOR(S) : Tian P. Chern

It is certified that error appears in the above-identified patent and that said Letters Patent is hereby corrected as shown below:

On the title Page:

[73] Assignee, after "Chang," and before Taiwan,
insert -- Taipei, --.

Column 1, lines 11 and 12, change "HZ" to -- Hz --.
Column 1, line 15, change "weight" to -- weighty --.
Column 1, line 52, before "input" change "the" to -- The --.

Column 2, line 23, after "form" change "a" to -- an --.
Column 2, line 34, after "43" and before "induces"
delete -- to --.

Column 3, line 6, after "circuit" and before "series"
delete -- in --.
Column 4, line 25, after "third" change "conductor"
to -- inductor --.

Signed and Sealed this

Fifteenth Day of October, 1996

Bruce Lehman

*Attest:*

BRUCE LEHMAN

*Commissioner of Patents and Trademarks*

*Attesting Officer*